United States Patent [19]

Roberts

[11] Patent Number: 4,613,841

[45] Date of Patent: Sep. 23, 1986

[54] INTEGRATED TRANSFORMER AND INDUCTOR

[75] Inventor: Victor D. Roberts, Burnt Hills, N.Y.

[73] Assignee: General Electric Company, Schenectady, N.Y.

[21] Appl. No.: 723,020

[22] Filed: Apr. 15, 1985

Related U.S. Application Data

[63] Continuation of Ser. No. 556,503, Nov. 30, 1983, abandoned, which is a continuation of Ser. No. 292,322, Aug. 12, 1981, abandoned.

[51] Int. Cl.[4] ..... H01F 17/06

[52] U.S. Cl. ..... 336/83; 336/160; 336/165; 336/178; 336/212

[58] Field of Search ..... 336/83, 84 R, 84 M, 336/65, 160, 165, 212, 178; 315/57, 62, 276, 282

[56] References Cited

U.S. PATENT DOCUMENTS

| | | | |
|---|---|---|---|
| 1,803,868 | 5/1931 | Porter | 336/165 X |
| 2,494,579 | 1/1950 | Pimlott et al. | 336/84 R |
| 2,519,224 | 8/1950 | Chiles, Jr. et al. | 336/165 X |
| 2,567,394 | 9/1951 | Nuttman | 336/83 |
| 2,823,359 | 2/1958 | Wentworth | 336/65 X |
| 2,949,591 | 8/1960 | Craige | 336/83 |
| 3,407,334 | 10/1968 | Attewell | 315/282 X |
| 4,060,759 | 11/1977 | Pana | 336/83 X |
| 4,123,690 | 10/1978 | Osteen | 315/276 X |
| 4,356,468 | 10/1982 | Van Laar | 336/84 R X |

FOREIGN PATENT DOCUMENTS

| | | | |
|---|---|---|---|
| 213236 | 6/1956 | Australia | 336/83 |
| 957152 | 5/1964 | United Kingdom | 336/83 |

*Primary Examiner*—Thomas J. Kozma

*Attorney, Agent, or Firm*—Marvin Snyder; James C. Davis, Jr.

[57] ABSTRACT

An electrical transformer comprises a hollow form exhibiting high magnetic permeability and interior projections extending between separable halves of the form to provide a low magnetic leakage transformer core. Primary and secondary windings are disposed around the central projections. Furthermore, there is included means internal to the form for providing a lower permeability magnetic circuit shunt path. The internal shunt path means is typically either a cylinder or disc structure. A reduction in stray magnetic flux is desirable since it means that smaller, less expensive transformers may be constructed. The transformer of the present invention is particularly useful in electronic ballast circuits for gas discharge lamps because the magnetic shunt path acts as a current-limiting inductor. Moreover, since the transformers of the present invention do not generate external magnetic fields, flux shields are not required to maintain high efficiency.

6 Claims, 11 Drawing Figures

INTEGRATED TRANSFORMER AND INDUCTOR

This application is a continuation of application Ser. No. 556,503, filed Nov. 30, 1983, now abandoned, which is a continuation of application Ser. No. 292,322, filed Aug. 12, 1981, now abandoned.

BACKGROUND OF THE INVENTION

This invention relates to transformers and, more particularly, to transformers which may be employed in gas discharge lamp ballast circuits.

Gas discharge lamps are unusual electrical devices primarily because they exhibit a negative resistance current-voltage characteristic. That is to say, once the arc within the lamp has been initiated, an increasing level of current between the lamp electrodes actually results in a decrease in the voltage across these electrodes. The ballast circuit which supplies electrical energy to such lamps, therefore, must usually provide some means of limiting the current through the lamp or lamps. As seen in the text, *Electric Discharge Lamps* by Waymouth (pages 317–318), current may be limited by providing a separate inductor or by employing an E-core transformer with primary and secondary legs and a third gapped leg acting as a magnetic shunt path. However, such E-cores are open structures and exhibit high levels of stray magnetic flux, and for reasons which are discussed below, such "leaky" transformers are inappropriate for the purposes described herein.

While it is possible to employ a separate, current-limiting inductor, such circuit construction designs are typically large, heavy and uneconomical in that more core transformer core material is employed than is necessary. Nonetheless, current limitation is a highly desirable, if not essential, feature of gas discharge lamp ballast circuits. This is because such lamps exhibit a negative resistance characteristic after the lamp arc has been struck (that is initiated) which permits the current to increase to destructive levels if not checked by ballast circuitry.

The above-mentioned text by Waymouth reinforces these lamp ballast design features and further indicates that leakage reactance may be added in an autotransformer configuration to reduce weight and cost. In particular, he indicates that a transformer may be conventionally constructed with primary and secondary windings wound on outer legs of conventional transformer cores with an inner leg providing a desired flux leakage path. However, there is no provision in these conventional designs to prevent the occurrence of stray magnetic flux leakage.

The problem of stray magnetic flux leakage is an important one. Gas discharge lamps, being driven by alternating current, accordingly produce time varying magnetic fields. These changing fields induce electric currents in surrounding conductive structures. Such structures are conventionally found in gas discharge lamp fixtures, luminaires and nearby electronic ballast circuitry. These induced currents cause heating and a loss in overall system efficiency. To eliminate these stray magnetic fields, flux shields, exhibiting high electrical conductance, must generally be employed. These flux shields add not only to the weight but also to the cost of the resulting ballast circuit.

Several U.S. patents address the problem of magnetic flux leakage and integrated transformer-inductor designs. In particular, U.S. Pat. No. 3,703,677 issued to Victor Farrow describes a conventional E-core with a gapped center leg where the leakage inductance is obtained by physical separation of the primary and secondary windings. He also describes the same problems discussed above with respect to magnetic flux leakage which tends to induce eddy current losses in surrounding metal structures. Because leakage flux may be reduced by placing the primary and secondary windings physically closer together, an alternate embodiment of the gapped center leg E-core design has also been suggested. In this transformer design, an outer transformer leg is gapped. Nonetheless, the problem of stray magnetic flux leakage occurs because of the inherently unshielded nature of the E-core transformer design.

Even though the magnetic shunt may considerably reduce the stray flux, there is still sufficient stray flux in these E-core designs to cause three important problems. First, the residual stray flux still produces eddy current losses which means that the transformer must be contained within a high conductivity flux shield. Second, stray flux creates a leakage inductance which is in addition to the leakage inductance created by the controlled leakage flux through the magnetic shunt. Thirdly, when a dual primary winding is used with circuits employing two power semiconductors in the output stage, such as is done in so-called push-pull circuits, the stray flux creates undesirable leakage inductance between these two primary windings. It is these last two problems which cause integrated transformers and inductors designed using E-cores to be larger than desirable. More specifically, the leakage inductance varies as the square of the number of turns. To keep the leakage inductance due to stray flux within acceptable limits, the designer is forced to use a relatively small number of turns on the primary and secondary. However, since the input voltage and lamp voltage are fixed, this creates a large voltage per turn on primary and secondary windings for transformers used in electronic gas discharge lamp ballast circuits. The magnetic field intensity in the transformer core is proportional to this voltage per turn divided by the core cross-sectional area. Since these high magnetic field intensities produce high loss in the material and may even saturate the material, the high voltage per turn caused by using a small number of turns forces the designer to use cores of larger cross-sectional area to prevent high magnetic field intensities from being created. Thus, the requirement for large cross-sectional area in turn increases the size and weight of the entire integrated transformer-inductor.

Some problems with stray magnetic flux have been alleviated in the past through the use of so-called pot-cores as transformer forms. However, until now, such core structures have never been employed in an integrated construction in which magnetic flux shunt paths are employed to produce an integrated transformer-inductor structure.

In certain inductors, particularly those operating at the normal 60 hertz line frequency, there has been observed a tendency on the part of some core structures to vibrate, thus causing accoustic noise and loss of efficiency. One inductor structure which has been suggested to solve this accoustic problem employs a pot-core-like structure with a center post disposed at least partially through an opening in a washer-shaped core end closure member. The purpose of this structure is to provide symmetry so that magnetic forces act uniformly on the center post in all directions so as to prevent osillatory forces from causing vibrations. However, such devices do not employ transformer structures and are not designed to incorporate magnetic leakage flux inductance.

SUMMARY OF THE INVENTION

In accordance with a preferred embodiment of the present invention, a pot-core includes a means internal to the pot-core for providing a lower permeability magnetic shunt path. In one embodiment of the present invention, this shunt path means comprises a cylindrical structure surrounding the centrally-disposed projections from the two halves of the pot-core. The length of the cylindrical structure is selected so as to provide a gap between the pot-core halves. In accordance with another embodiment of the present invention, the magnetic shunt path means comprises a disc structure extending from the outer pot-core walls toward, but not necessarily touching, the centrally-disposed pot-core projections. The pot-core comprises a substantially closed, hollow and substantially cylindrical form comprising high magnetic permeability material, the form being divided in the axial direction into two pieces to form the pot-core halves. High permeability projections extend inward from each of the flat portions of the pot-core halves, these projections are either proximal or abutting to form a high permeability magnetic circuit. First and second electrical windings are disposed around at least one of the projections. In the embodiment of the present invention employing a cylindrical magnetic shunt path means, either the primary or secondary winding may be wound on this cylindrical structure; however, exactly one of these windings must be so disposed.

Accordingly, it is an object of the present invention to provide an integrated tranformer-inductor having low weight, low magnetic flux leakage and a small size.

It is also an object of the present invention to provide an integrated transformer-inductor structure for use in an electronic gas discharge lamp ballast circuit.

DESCRIPTION OF THE FIGURES

The subject matter which is regarded as the invention is particularly pointed out and distinctly claimed in the concluding portion of the specification. The invention however, both as to organization and method of practice, together with further objects and advantages thereof, may best be understood by reference to the following description taken in conjunction with the accompanying drawings in which:

DETAILED DESCRIPTION OF THE INVENTION

Figure 1:
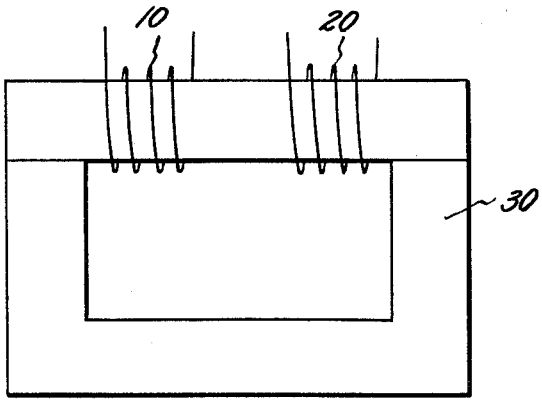
FIG. 1 (PRIOR ART)
FIG. 1 illustrates a conventional U-I transformer core.

FIG. 1 illustrates a conventional U-I transformer core 30 having primary winding 10 and secondary winding 20. Such cores may be employed in gas discharge lamp ballast circuits but are, in fact, generally not used. The leakage magnetic flux is controlled by physically separating the primary and secondary windings. This transformer construction, while common for some purposes, nonetheless exhibits a high degree of stray magnetic flux and is inappropriate in those circuits in which induced eddy current losses from stray magnetic flux are important factors in design.

Figure 2:
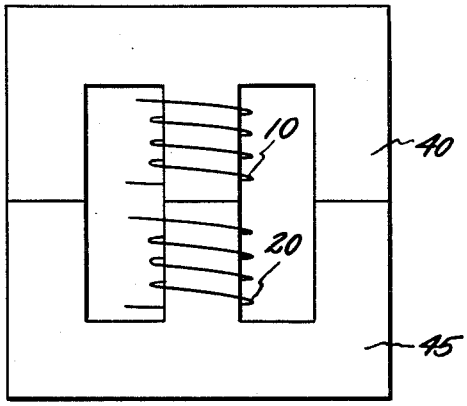
FIG. 2 (PRIOR ART)
FIG. 2 illustrates a conventional EE-core transformer.

FIG. 2 illustrates a conventional E-core design in which some magnetic shielding is provided by the fact that the primary and secondary windings are mounted on the center leg of E-cores 40 and 45, respectively. Nonetheless, unacceptable levels of stray magnetic flux still persist because of the open construction. Also, this construction does not provide the required leakage inductance between primary and secondary. In contrast, however, the present invention not only provides the required series inductance (leakage inductance) between primary and secondary windings, but also eliminates stray magnetic flux which can cause eddy current losses in surrounding structures.

Figure 3:
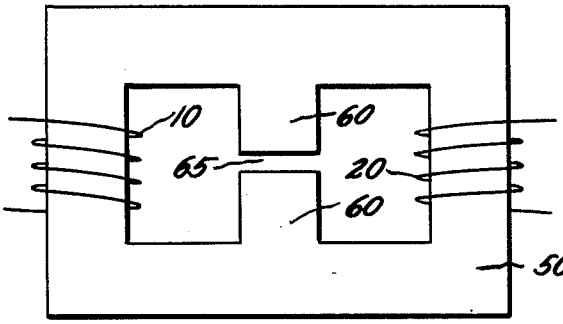
FIG. 3 (PRIOR ART)
FIG. 3 illustrates an EE-core transformer with center gapped magnetic shunt.

FIG. 3 illustrates one form of integrated transformer design in which gap 65 is provided in center leg 60 in a conventional E-core design similar to that shown in FIG. 2. Again, this structure still provides more stray leakage flux than is desired and requires an added cost component, in the form of a high conductivity shield to reduce any current losses. While core 50 may comprise a pair of abutted E-cores, a solid or cast ferrite structure is also possible for use as core 50.

Figure 4:
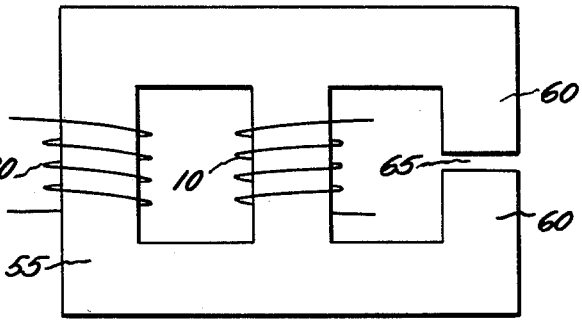
FIG. 4 (PRIOR ART)
FIG. 4 illustrates an EE-core transformer with a magnetic shunt gap in an outer leg.

The structure shown in FIG. 3 is worth considering further since, in conjunction with a gas discharge lamp connected to output winding 20, a current-limiting inductive effect occurs in the following described manner. Normally, because of the high magnetic permeability of core 50, the flux flows around (rather than through) center leg 60 and induces voltage across secondary winding 20. When used in conjunction with a gas discharge lamp connected to the output circuit (i.e., the secondary circuit) the increased current flow occurring once the arc is struck induces a counterflux in the core leg surrounded by the secondary winding. This counterflux decreases the net flux in the outer leg and produces a correspondingly larger amount of magnetic flux through gap 65. The decreased net flux in the outer leg results in a decreased voltage across the secondary winding which means that less current flows in the secondary circuit. Thus, the secondary current is effectively limited. The same effect occurs in the transformer core design illustrated in FIG. 4. Here core 55 possesses gap 65 in one of its outer legs 60. Here primary 10 is wound on the center leg with secondary 20 wound on one of the outer legs, the remaining outer leg being gapped to provide the magnetic shunt. Since the primary and secondary are close together, leakage magnetic flux is reduced and a greater number of turns may be used without the leakage inductance due to stray magnetic flux becoming too large. Even this design, however, has more stray flux than is necessary or desirable, thus requiring a relatively small number of turns and a larger core cross-sectional area than is possible with the present invention.

Figure 5:
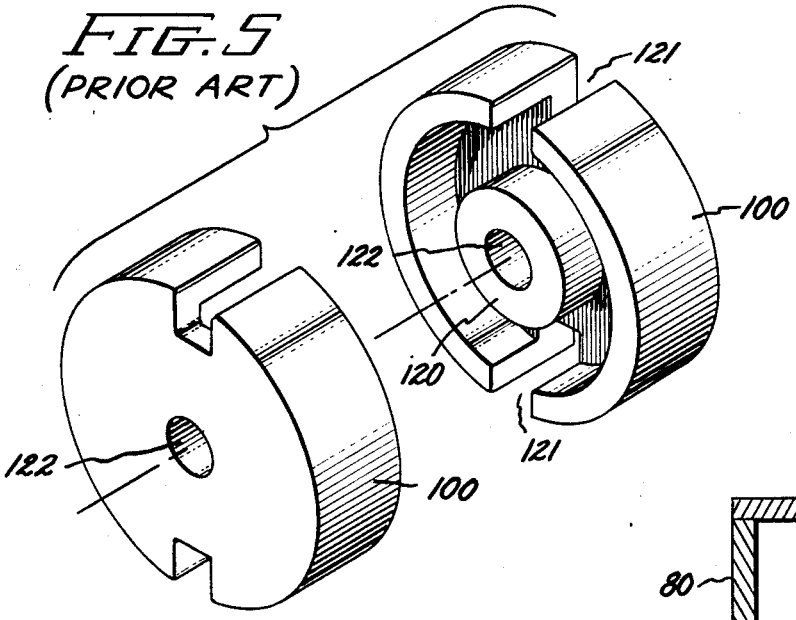
FIG. 5 (PRIOR ART)
FIG. 5 illustrates a conventional pot-core construction.

FIG. 5 illustrates a conventional pot-core having symmetric halves 100. Each pot-core portion has central projection 120. These projections extend inward into a substantially hollow interior of the joined core halves. Projections 120 generally extend a sufficient distance to abut one another so as to form a closed magnetic flux path. For convenience, central projections 120 may also possess apertures 122 which may be employed for the insertion of fastening or mounting means. Core halves 100 may also possess slots 121 which are generally employed for cooling or for the passage of electrical conductors to external circuitry. These cores typically comprise a material having a high magnetic permeability, such as ferrite. It should be understood that here, and in the appended claims, while a structure having a cylindrical shape and circular cross section is shown, many other shapes and sizes of core may be employed for use in the present invention. One essential feature of pot-core construction is the formation of a hollow interior using two separable pieces which are joinable to form a substantially closed magnetic circuit. Another essential feature of the pot-core construction is the use of projections extending inwardly into the hollow interior and abutting so as to form a high permeability magnetic flux path.

Figure 6:
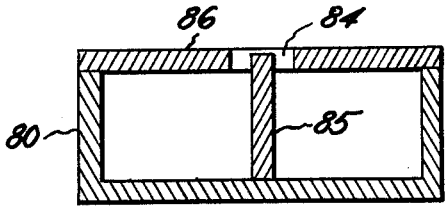
FIG. 6 (PRIOR ART)
FIG. 6 illustrates an inductor core for reducing acoustic noise.

FIG. 6 illustrates the cross section of a core employed as an inductor form comprising cup-shaped member 80 with central post 85 and washer-shaped end closure member 86 extending from the walls of cup 80 inwardly to the vicinity of central post 85 but not in contact therewith so as to form gap 84. This structure has been suggested as one which reduces accoustic noise produced in certain inductive components. This reduction in accoustic noise is accomplished through the use of symmetrical construction in which electromagnetic forces on post 85 are uniformly distributed in a radial direction so that no net force acts on post 85 to cause it to vibrate or oscillate. However, such a core structure has not been employed for the construction of transformers, nor has it been suggested as a core structure for housing an integrated transformer and inductor.

Figure 7A:
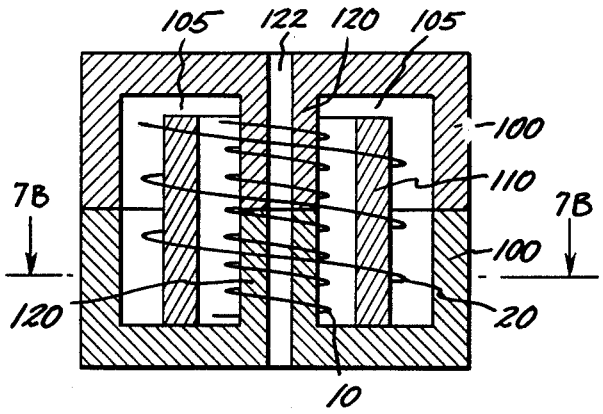
FIG. 7A illustrates a partial cross-sectional side elevation view illustrating one embodiment of the present invention.
Figure 7B:
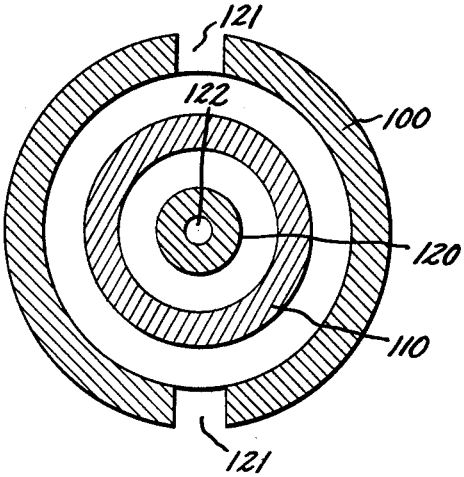
FIG. 7B is a cross-sectional plan view through the core shown in FIG. 7A.

FIG. 7A illustrates one embodiment of the present invention. The core structure comprises core halves 100 which are preferably identical mating structures each having central projection 120 and aperture 122 therethrough for fastening or mounting the device. Because the assembled core halves form a substantially closed magnetic flux path, the problems associated with magnetic flux leakage are negligible. The most significant structure for the purposes of the present invention is nonetheless cylinder 110 which also preferably comprises high magnetic permeability material. This cylinder extends between core halves 100 so as to form gap 105 between cylinder 110 and one of the core halves. Cylinder 110 is held within core halves 100 by any convenient means such as adhesives, non-magnetic, insulating bushings, or packing material. If desired, core halves 100 may be provided with convenient circular grooves (not shown) to increase the positioning stability of cylinder 110. Cylinder 110 provides a means internal to the pot cores for providing a lower permeability magnetic circuit shunt path. It is this device which produces the inductive, current-limiting effects seen, for example, in the device shown in FIG. 3. However, the present device exhibits negligible flux leakage and greatly increases the design capabilities as described below. FIG. 7A also illustrates the presence of primary winding 10 and secondary winding 20. While it is possible to dispose either the primary or secondary winding on central projection 120, the preferred embodiment of the present invention employs the primary winding disposed on central projection 120 and a secondary winding disposed on cylinder 110. (The pot-core permits a greater degree of magnetic coupling between the primary and secondary circuits and generally improves the transformer characteristics.) FIG. 7B is a cross section, as shown, through the core of the present invention. FIG. 7B illustrates, in plan view, the relationship between cylindrical magnetic shunt path means 110, projection 120 and the outer wall of cylindrical core half 100. FIG. 7B also illustrates the presence of notches 121 which primarily function to provide an aperture through which electrical connections may be made. In some cases, as when gap 105 is small, it is also possible, though not shown, to employ notches or similar apertures in cylindrical shell 110. For clarity, primary and secondary windings 10 and 20, respectively, are not shown in FIG. 7B.

Figure 8A:
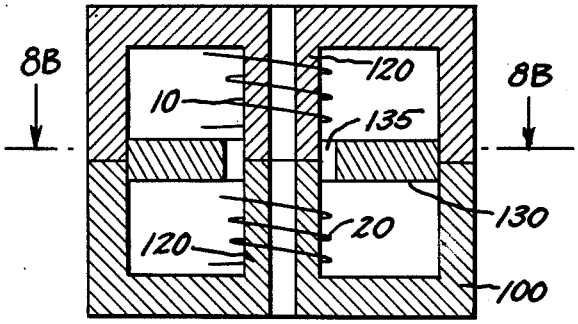
FIG. 8A is a partial cross-sectional side elevation view illustrating another embodiment of the present invention.
Figure 8B:
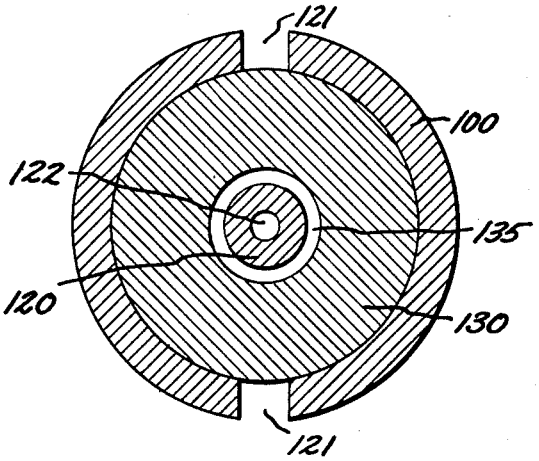
FIG. 8B is a cross-sectional plan view of the core shown in FIG. 8A.

FIG. 8A illustrates another embodiment of the present invention in which the magnetic circuit shunt path is provided by disc-shaped structure 130 which, like core halves 100 and cylinder 110, comprises a high permeability magnetic material such as ferrite. Disc 130 possesses a central aperture having a size greater than the diameters of projections 120 so as to form gap 135 between disc 130 and projections 120. In the embodiment shown, disc 130 extends radially inward from the walls of core halves 100. However, it is also equally possible to provide a gap between disc 130 along its radially-outer periphery between it and the walls of core 100. It is also readily seen that both radially-inner and radially-outer gaps may be provided as desired. Such construction variations are readily provided and do not affect the operation of the present invention. This is equally true for the gap or gaps provided by cylindrical structure 110 shown in FIG. 7A. Disc 130, furthermore, does not require a central position in the axial direction. However, in the embodiment illustrated in FIG. 8A, the primary and secondary windings 10 and 20, respectively, are disposed around central projections 120 on opposite sides of disc 130. FIG. 8B further clarifies, in plan view, the relationship between projections 120, disc 130 and pot-core halves 100. FIG. 8B also illustrates the location of the conveniently-provided nothces 121 for the passage of electrical connections.

The present invention provides several significant advantages not found in prior art devices and, in particular, not found in electronic ballast transformers for gas discharge lamps. In particular, the present invention provides close physical positioning between the primary and secondary windings. This further cuts down the possibility of stray magnetic flux leakage. Because the structure shown exhibits a very low stray magnetic flux, a relatively large number of turns may be used which in turn allows one to choose a core of relatively small cross section. The size and weight reduction of the integrated transformer-inductor disclosed herein leads to an overall reduction in size and weight of these devices and makes them eminently suitable for use in electronic ballasts for gas discharge lamps. The internal magnetic circuit shunt path means of the present invention may be provided in several ways. First, cylinder 110 or disc 130 may be constructed from the same material as the main core halves 100. In this case, gap 105 or 135 is provided. In this case, the leakage inductance is a function of the size of the gap. Additionally, the magnetic circuit shunt path means (cylinder 110 or disc 130) may be molded into a basic pot-core structure or it may be a separate part which is inserted during assembly. For reasons of manufacturing ease, separate assembly is preferred. Secondly, additional cylinder 110 or disc 130 may be constructed from a material exhibiting a lower magnetic permeability than that of the main pot-core halves. In this case, no gap is needed, but may be provided anyway, to create a magnetic shunt path. Here the leakage inductance is a function of the size of the gap, if any , and ratio of the permeability of the additional cylinder or disc to the permeability of the main pot-core halves. Furthermore, to assist in assembly, cylinder 110 may be incorporated into a bobbin on which the outer (usually secondary) windings are placed. For example, the center post of the bobbin may be constructed from ferromagnetic material, while the bobbin end plates are constructed from a plastic material in a conventional manner. Just as in the case in which the magnetic circuit shunt path means is provided by cylinder 110, the disc magnetic shunt may also be formed as part of a bobbin used to hold one more of the primary or secondary windings. The integrated transformer inductors of the present invention generate very negligible external magnetic fields. Therefore, expensive and weighty flux shields are not required to maintain high circuit efficiency.

Figure 9:
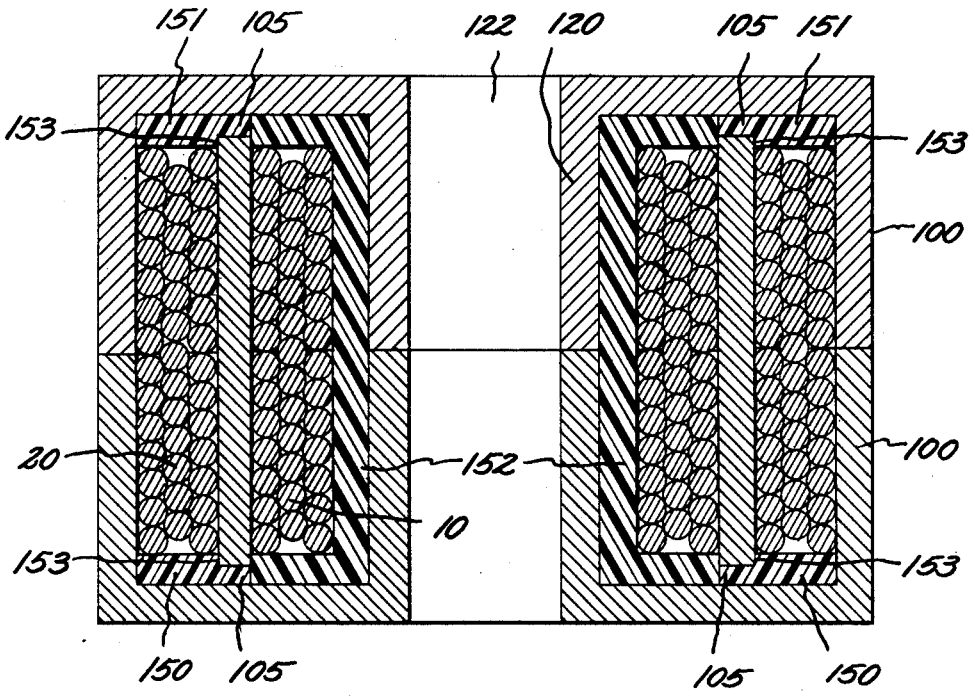
FIG. 9 is a cross-sectional side elevation view illustrating the use of bobbins and spacers in the present invention.

FIG. 9 more particularly illustrates the use of these bobbins. Here primary winding 10 is disposed on bobbin 152 which preferably comprises a nonmagnetic, dielectric material such as nylon or other plastic. Bobbin 152 is shaped like a cylinder with end flanges for supporting primary winding 10. Cylindrical shell 110 is disposed between lower annular spacer 150 and upper annular spacer 151. These spacers preferably comprise a material which is also both dielectric and nonmagnetic. Spacers 150 and 151 may also contain annular lips 153 for more secure support of cylindrical shell 110. The thickness of spacers 150 and 151 may be selected, along with the axial length of shell 110, to determine the thickness of gap 105. The arrangement of bobbin and spacers shown in FIG. 9 is particularly advantageous since it permits the primary and secondary windings to be wound on bobbin 152 and shell 110 independently. Likewise, their assembly into core halves 100 may also be done independently.

From the above it may be appreciated that the transformer of the present invention comprises a small, lightweight device suitable for use in electronic gas discharge lamp ballast circuits. It may be further appreciated that the transformer of the present invention provides an integrated transformer and inductor exhibiting negligible magnetic flux leakage. It is this low leakage which contributes to the low eddy current losses and high energy efficiency for circuits employing the present invention.

While the invention has been described in detail herein, in accord with certain preferred embodiments thereof, many modifications and changes therein may be affected by those skilled in the art. Accordingly, it is intended by the appended claims to cover all such modifications and changes as fall within the true spirit and scope of the invention.

The invention claimed is:

1. An electrical transformer comprising:

a substantially closed hollow and substantially cylindrical form comprising high permeability magnetic material, said form being divided in the axial direction into two cup-shaped pieces having a flat bottom portion and rounded sides;

high permeability opposing projections extending inward from each of the flat portions of said forms, said projections abutting to form a closed magnetic circuit;

a primary electrical winding disposed about at least one of said projections;

a secondary electrical winding disposed about at least one of said projections; and magnetic shunt means internal to said cylindrical form and disposed between said primary electrical winding and said secondary electrical winding for providing a lower permeability magnetic circuit shunt path, said magnetic shunt means comprising an internal cylindrical shell disposed about said projections and extending between said flat form portion.

2. The transformer of claim 1 in which said shell comprises material having lower magnetic permeability than said form.

3. The transformer of claim 1 in which said shell extends between said flat portions so as to provide at least one gap between said shell and at least one of said forms.

4. The transformer of claim 1 in which said secondary winding is disposed about said shell.

5. The transformer of claim 1 further including apertures in said form for external connection of said primary and secondary electrical windings.

6. An electrical ballast capable of performing as a transformer with a series inductor, for use with a gas discharge lamp to provide impedance matching and control of current supplied to said gas discharge lamp, said ballast comprising:

a substantially closed hollow form, comprising high magnetic permeability material, said form being divided into two pieces so as to define an interior region;

high permeability projections extending inward from each of said form pieces, said projections abutting to form a high permeability magnetic circuit;

a primary electrical winding disposed about at least one of said projections;

a secondary electrical winding disposed about at least one of said projections; and magnetic shunt means internal to said form and disposed between said primary electrical winding and said secondary electrical winding for providing a lower permeability magnetic circuit shunt path than is provided by said form, said magnetic shunt means comprising an internal cylindrical shell disposed about said projections and extending between said form pieces, said magnetic shunt means helping to control current supplied to said gas discharge lamp.

* * * * *